United States Patent [19]

Takenoya

[11] 4,308,814

[45] Jan. 5, 1982

[54] ELECTRONIC SEWING MACHINE WITH A STITCH CONTROL DEVICE

[75] Inventor: Hideaki Takenoya, Hachioji, Japan

[73] Assignee: Janome Sewing Machine Co., Ltd., Tokyo, Japan

[21] Appl. No.: 136,043

[22] Filed: Mar. 31, 1980

[30] Foreign Application Priority Data

Apr. 20, 1979 [JP] Japan ..... 54-47881
May 22, 1979 [JP] Japan ..... 54-62243

[51] Int. Cl.[3] ..... D05B 3/02
[52] U.S. Cl. ..... 112/158 E
[58] Field of Search ..... 112/158 E, 158 R, 220

[56] References Cited

U.S. PATENT DOCUMENTS 3,929,081 12/1975 Ketterer ..... 112/158 E X
3,984,745 10/1976 Minalga ..... 112/158 E X

*Primary Examiner*—Peter P. Nerbun
*Attorney, Agent, or Firm*—Michael J. Striker

[57] ABSTRACT

A single motor controls needle swing and fabric feed in a sewing machine. The motor is connected to a transmission which alternately locks either the needle swing or the fabric feed while releasing either the fabric feed or the needle swing as the case may be. The motor is operated in accordance with a predetermined program by an electronic control system. Multiplexers are used in order to alternately transmit feed data and needle control data to the motor. Two embodiments are taught: one embodiment being purely digital in nature, and the other embodiment including an analog feedback loop.

17 Claims, 12 Drawing Figures

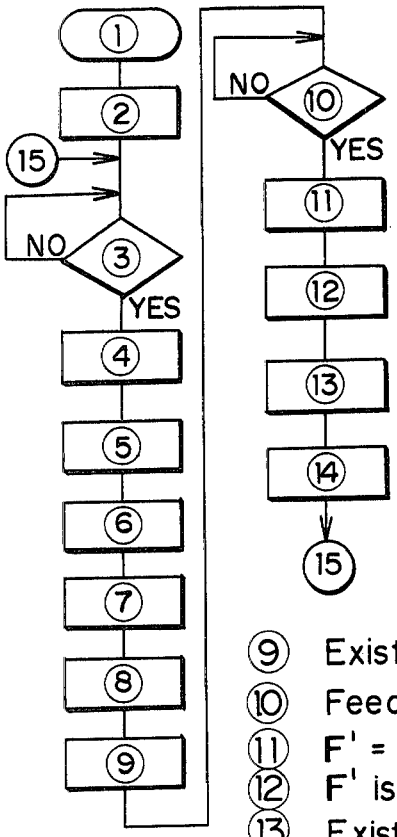

FIG. 9

① Control power source is applied
② Initial setting
③ Needle swing control phase
④ Designated address W, F is read out
⑤ Next needle control data = W
⑥ Next feed control data = F
⑦ W' = Next data W - Existing data W
⑧ W' is issued
⑨ Existing data W = Next data W
⑩ Feed control phase
⑪ F' = Next data F - Existing data F
⑫ F' is issued
⑬ Existing data F = Next data F
⑭ Address is advanced
⑮ RETURN

FIG. 10

| Addresses | Contents of ROM | |
|---|---|---|
| | **W** | **F** |
| N | 10 | 30 |
| N + 1 | 20 | 30 |
| N + 2 | 30 | 0 |
| N + 3 | 20 | 30 |
| N + 4 | 10 | 30 |
| N + 5 | 0 | 0 |
| N + 6 | RET | |

ELECTRONIC SEWING MACHINE WITH A STITCH CONTROL DEVICE

BACKGROUND OF THE INVENTION

1. Field of the Invention

The invention relates to an electronic sewing machine, and more particularly relates to a sewing machine, in which a single actuator is used to control the operations of stitch forming instrumentalities including the needle bar swinging device and the fabric feeding device.

2. Description of the Prior Art

Conventional electronic sewing machines generally use two actuators, one for controlling needle movement, and the other for controlling fabric feed. Power supplies for conventional electronic sewing machines thus require a bulky transformer and also require two control circuits to operate the actuators. Such a complex and large system is very difficult to fit into the limited space within a sewing machine and is also very costly.

SUMMARY OF THE INVENTION

The present invention has been provided such defects and disadvantages of the prior art, and it is a primary object of the invention to provide an electronic sewing machine with a single actuator for controlling the operations of the stitch forming instrumentalities of the sewing machine including the needle bar and the feed dog.

It is another object of the invention to provide an electronic sewing machine which is simple in structure and economical in mass-production.

For attaining these objects, a series of gears in a transmission is connected to the actuator to operate members which are respectively operatively connected to the needle bar and the feed dog. Holding devices are provided and are operated in synchronism with rotation of the main shaft of the sewing machine, one of the holding devices holding one of the members while the other one releases the other member. The actuator is driven in accordance with a predetermined program which is determined by the pattern selected to suitably operate needle swing and feed dog motion through the transmission.

The other features and advantages of the invention will be apparent from the following description of the preferred embodiments with reference to the attached drawings.

BRIEF DESCRIPTION OF THE DRAWINGS

FIG. 9 shows a flow chart of the operation of the invention;

FIG. 10 is a table showing the addresses and the stitch control data within an electronic memory used in the invention;

DETAILED DESCRIPTION OF PREFERRED EMBODIMENTS

Figure 1:
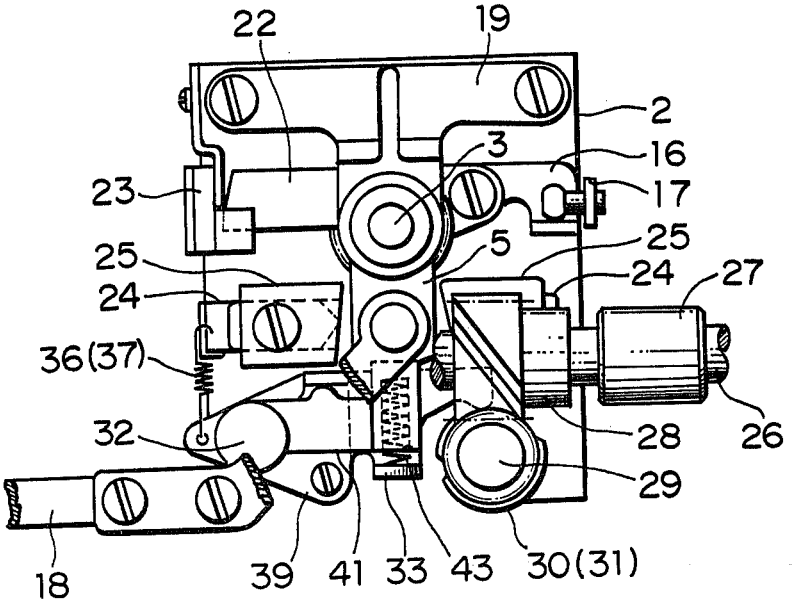
FIG. 1 is a top view of a mechanism of the invention.
Figure 2:
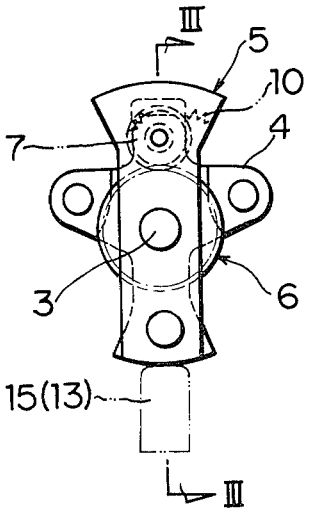
FIG. 2 is a front elevational view of a part of the mechanism shown in FIG. 1.
Figure 3:
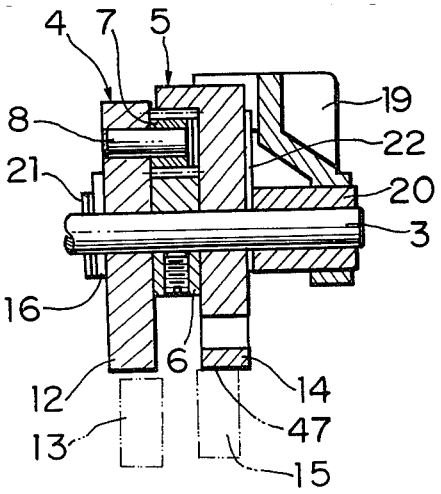
FIG. 3 is a sectional view taken along line III—III in FIG. 2.
Figure 4:
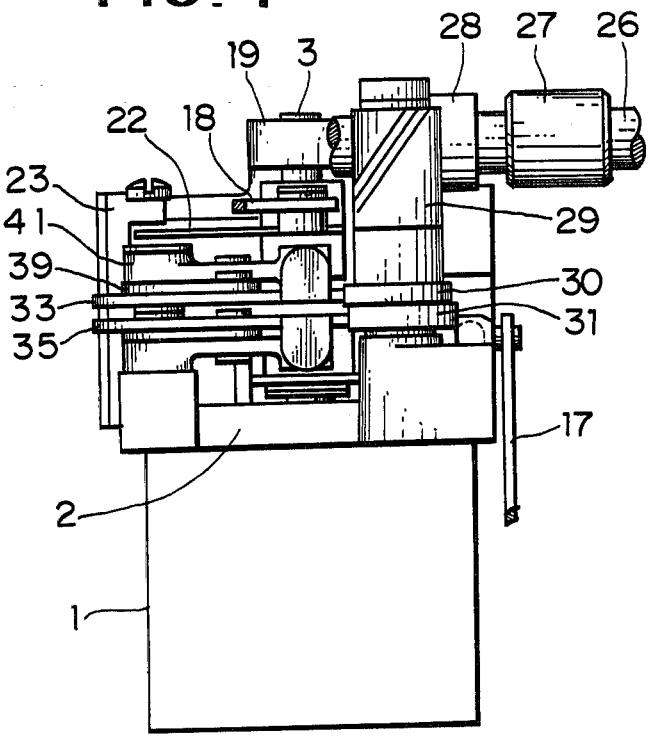
FIG. 4 is a bottom view of the mechanism shown in FIG. 1.
Figure 5:
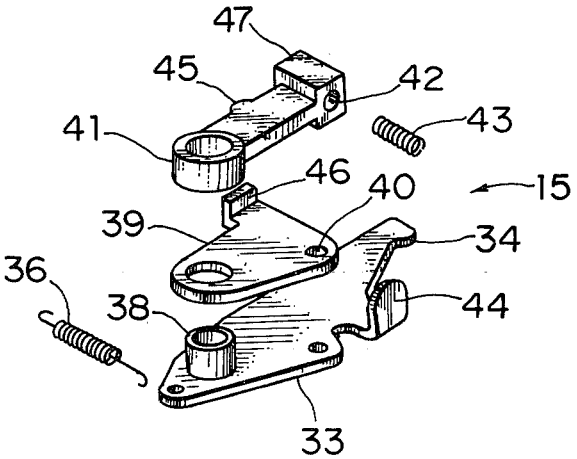
FIG. 5 is an exploded view of a portion of the mechanism shown in FIG. 1.

In reference to FIGS. 1–5, reference numeral 1 in FIGS. 1 and 4 denotes a pulse motor for controlling a needle bar swing and fabric feed in a sewing machine (not shown). Pulse motor 1 is secured to a bracket 2 which is fixedly mounted to the sewing machine. Pulse motor 1 has a central drive shaft 3 on which a fabric feed control arm 4 and a needle swing control gear 5 are pivotally mounted. A gear 6 is secured to central drive shaft 3 between fabric feed control arm 4 and needle swing control gear 5, as is shown in FIG. 3. An intermediate gear 7 is pivotally mounted on a pin 8 which is secured to fabric feed control arm 4, and both engage with gear 6 and the inner teeth 10 of needle swing control gear 5 as is shown in FIG. 2. When needle movement is required, needle swing control gear 5 is rotated while fabric feed control arm 4 is prevented from rotation by a lock mechanism 13. In this case, gears 5, 6, 7 constitute a simple series of gears, having 80, 40, and 20 teeth, respectively. (The number of teeth in needle swing control gear 5 is converted to the circumference equivalent.) Therefore, needle swing control gear 5 is rotated around central drive shaft 3 at a speed which is $\frac{1}{2}$ of the speed of central drive shaft 3 and opposite thereto. On the other hand, when fabric feed is required, fabric feed control arm 4 is rotated while needle swing control gear 5 is prevented from rotation by a lock mechanism 15. In this case, the gears 5, 6, 7 constitute a planet series of gears, and fabric feed control arm 4 is rotated around central drive shaft 3 at a speed which is $\frac{1}{3}$ of the speed of gear 6 and in the same direction. The movement of fabric feed control arm 4 is transmitted, through transmission links 16, 17, to a feed regulator (not shown) for controlling the movement of a feed dog in the sewing machine. On the other hand, the movement of needle swing control gear 5 is transmitted, through a transmission rod 18, to a needle swinging mechanism (not shown) in the sewing machine.

A support 19 is secured to bracket 2 and supports a bushing 20, which is mounted on one end of central drive shaft 3 to prevent axial movement of needle swing control gear 5, and an E-ring 21 is secured to central drive shaft 3 opposite bushing 20 to prevent axial movement of fabric feed control arm 4 and transmission link 16. A screening plate 22 is secured to needle swing control gear 5 and thus rotates therewith to periodically interrupt the light from sensor 23, which is secured to bracket 2, at a predetermined angular position of needle swing control gear 5. A similar position sensing device (not shown) is connected to feed control arm 4. These sensors are employed to set the initial position of pulse motor 1. Stops 24 are secured to bracket 2 to limit the movement of feed control arm 4, while stops 25 limit the movement of needle swing control gear 5.

Reference numeral 26 denotes a main shaft in the sewing machine, and the numeral 27 indicates a bushing thereon. A torsion gear 28 is secured to and rotates with main shaft 27, and engages with a gear 29 for controlling lock mechanisms 13 and 15. The torsion gear 28 transmits rotation of main shaft 26 to gear 29 in a normal 1:1 ratio. Locking cams 30, 31 are formed on torsion gear 29 with different angular positions for controlling lock mechanisms 13, 15 respectively. A needle lock control follower 33 with a pawl 34 and a similar feed lock control follower 35 are pivotally mounted on bracket 2 by means of a pin 32, and are each brought into engagement with the needle lock control cam 30 and the feed lock control cam 31 by tension springs 36, 37 respectively. Needle lock control follower 33 has a collar 38 at its center of rotation. An adjusting plate 39 is mounted on collar 38 and is secured to the follower 33 at a hole 40 on plate 39. One end of a needle lock element 41 is rotatably mounted on collar 38 of needle lock control follower 33. The needle lock element 41 is provided at its other end with chamber 42, to receive a compression spring 43 which protrudes, in part, out of chamber 42. The protruding end of spring 43 is held by an upper projection 44 of needle lock control follower 33. When pawl 34 of needle lock control follower 33 engages the lower lobe of needle lock control cam 30, the intermediate projection 45 of needle lock element 41 is pressed against the upper projection 46 of the adjusting plate 39 by spring 43, and contact face 47 of needle lock element 41 is spaced from opposed end 14 of needle swing control gear 5. When the pawl 34 of needle lock control follower 33 engages the higher lobe of needle lock control cam 30, needle lock control follower 33 (in FIG. 5) is turned counterclockwise against tension spring 36 and needle lock element 41 is turned in the same direction by compression spring 43. As a result, contact face 47 of needle lock element 41 is pressed against opposite end 14 of needle swing control gear 5 by compression spring 43, while upper projection 46 of adjusting plate 39 is spaced counterclockwise from intermediate projection 45 of needle lock element 41. The particulars of the needle mechanism 15 are the same as those of the feed lock mechanism 13, as just described above.

Figure 6:
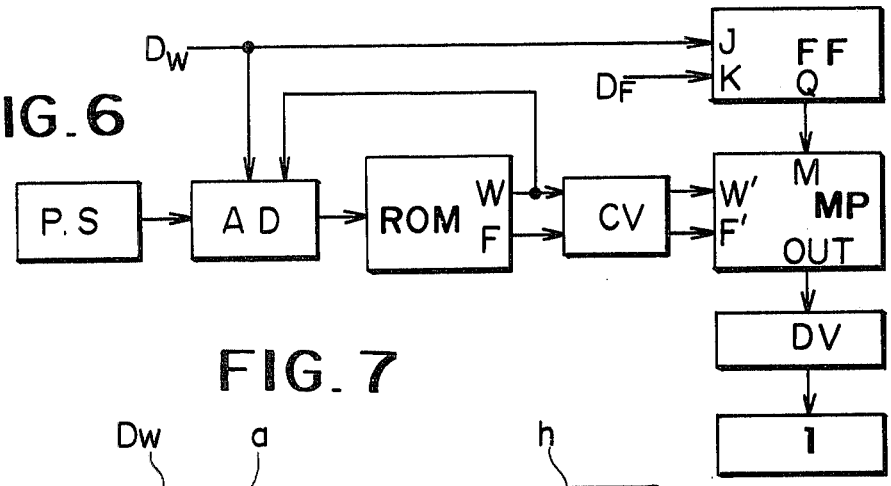
FIG. 6 is a block diagram of a first embodiment of the invention.

FIG. 6 shows a block diagram of a first embodiment of the invention, in which ROM is an electronic memory storing pattern signals for producing stitch patterns. If one of the stitch patterns is selected at a pattern selecting device PS and the initial address of the pattern is designated at an address device AD, the ROM delivers a needle control signal W (for an initial stitch) and a feed control signal (for a next next stitch) to signal converter CV. As to the following stitches, a needle position detector (not shown) on the main shaft of the sewing machine produces a high level signal Dw each time the needle emerges from the fabric to be sewn, to cause address device AD to advance the addresses of the ROM, and thereby to successively produce stitch control signals W and F for following stitches in the pattern. When the ROM has produced the last control signal in the pattern selected, it then produces a return signal to return to its initial address.

Figure 7:
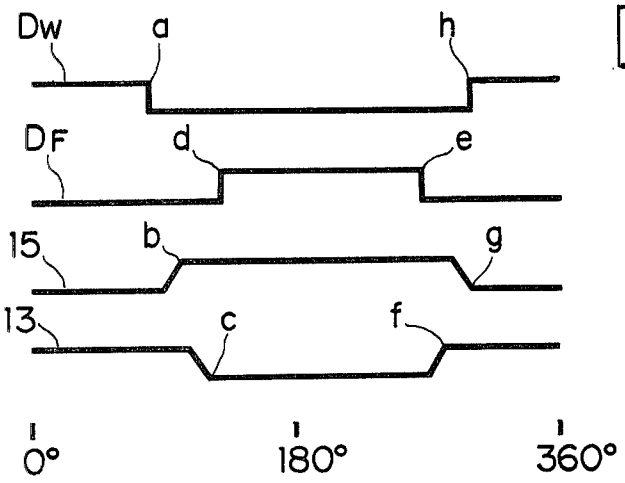
FIG. 7 shows control phases executed by the invention.

The signal converter CV receives, once per stitch, stitch control signals W, F for the needle and the feed control, and calculates differential stitch information between data for the next stitch and data for the current stitch, and then feeds this differential stitch information W', F' to a multiplexer MP. FF is a JK flip-flop with input terminals J and K. Input terminals J and K receive, respectively, signals Dw from a needle position detector (not shown) and $D_F$ from a feed position detector (not shown) on the main shaft of the sewing machine. As shown in FIG. 7, signal Dw from the needle position detector is logically high when the rotation angle of the main shaft is less than 180° away from the lower dead point of the needle. (A 0° rotation angle of the main shaft corresponds to the upper dead point of the needle and serves as a reference.) Signal $D_F$ from the feed position detector is logically high level when the rotation angle of the main shaft is adjacent 180°, i.e., adjacent the lower dead point of the needle.

Input terminals J, K of the flip-flop FF are either both logically low or only one is logically high. If input terminal J is logically high, output Q is logically high and the high signal at output Q is applied to the mode switching terminal M of multiplexer MP. Multiplexer MP then transfers differential stitch information W' to a pulse motor driver DV. If the input terminal K is high, output Q is low, and multiplexer MP transfers differential stitch information F' to pulse motor driver DV. Upon receiving such data, the pulse motor driver DV suitably drives the pulse motor 1 based on this differential stitch information.

FIG. 7 shows the operation phases of the needle control locking mechanism 15 and the feed control locking mechanism 13 in response to signals Dw, $D_F$ from the needle and feed position detectors. The high levels show phases when locking mechanisms 13, 15 lock the feed control arm 4 and the needle swing control gear 5 respectively, and the low levels show phases when locking mechanisms 13, 15 release the feed control arm 4 and the needle swing control gear 5 respectively.

Operation of the invention is as follows:

If the sewing machine is driven and the needle position detector signal Dw becomes low at point (a) in FIG. 7 where the needle is not yet penetrating the fabric, the pulse motor 1 is set to its initial position. At point (b), the pawl 34 of the needle lock control follower 33 engages the high lobe of needle lock control cam 30 and needle lock element 41 is pressed against needle swing control gear 5 and hold it to fix the lateral position of the needle. At point (c), the feed control locking mechanism 13, which has previously been set in its locking position, releases feed control arm 4. On the other hand, electronic memory ROM produces a needle control W for the current stitch and a feed dog signal F for the next stitch at a point (not shown) corresponding to a rising point of the signal Dw just before 0°. When the feed position detector signal $D_F$ becomes high at point (d), the mode switching signal M of the multiplexer MP transmits differential feed control data F' which drives pulse motor 1. Pulse motor 1 rotates gear 6 which rotates intermediate gear 7 on needle swing control gear 5, which is held fixed by needle control locking mechanism 15. The feed control locking arm 4 is, therefore, turned at ⅓ of the angular speed of gear 6 and in the same direction, thereby controlling movement of the feed dog through transmission link 16 and the feed regulator (not shown).

As the sewing machine is rotated further and the feed dog signal $D_F$ becomes low at point (e), pulse motor 1 finishes feeding and stops. Then, at point (f), the feed control arm 4 is locked by feed control locking mechanism 13, and, at point (g), needle swing control gear 5 is released. When the needle swing signal Dw becomes high, at point (h), a set of new data is read out from ROM, and mode switching signal M of the multiplexer MP transmits differential needle swing data W' to pulse motor 1. Gear 6 then rotates intermediate gear 7, and the needle swing control gear 5 is rotated at ½ of the angular speed of gear 6 in the opposite direction, to control swinging of the needle through transmission rod 18.

To explain the production of stitches in the embodiment shown in FIG. 8, the data and the process used to generate it will be explained with reference to FIG. 9. If the control power source of the circuit in FIG. 6 is turned on, the mechanical elements are set to their initial positions. The, it is determined if needle position detecting signal Dw is at point (h) in FIG. 7, or if it is high because pattern selecting device P.S has been operated. If needle position detecting signal Dw is high immediately after pattern selecting device P.S has been operated, the initial address N (in FIG. 10) of the selected pattern is designated, and values 10 and 30 of the needle and feed control data W and F are read out from ROM. In FIG. 10, the values of W are shown in decimal numbers for the needle coordinates in FIG. 8, and the values of F are shown in decimal numbers for the feeding distances.

For the purpose of converting data W, F into signals W', F' for controlling pulse motor 1, the converter CV deals with the data W, F as the next-data. In the initial setting of pulse motor 1, the current values of W, F are both zeroed, and in a calculation in which W'=the next data W less the existing data W, for determining the rotation amount of the pulse motor in the next process, the next data W' is equal to 10. Data W' is supplied to drive device DV since the mode switching signal M of the multiplexer MP is high. Then, pulse motor 1 is driven to rotate needle swing control gear 5 from its original position corresponding to needle coordinate 0 to its next position corresponding to needle coordinate 10. This is the first stitch coordinate 0. Then, the next data W is set equal to the existing data W to make the calculation for determining the next stitch. If the feed position detecting signal $D_F$ is high, feed control data F showing the feeding amount is read out from the ROM and is processed in the same conversion and calculation as in the needle control process. Namely, if the feeding amount is constant, it follows that F'=the next data F—the existing data F=0. In this case, the fabric feed control arm 4 is held in a predetermined inclination in each stitch. If the feeding amount differs from stitch to stitch, the difference is produced by pulse motor 1 which is appropriately controlled.

Figure 8:
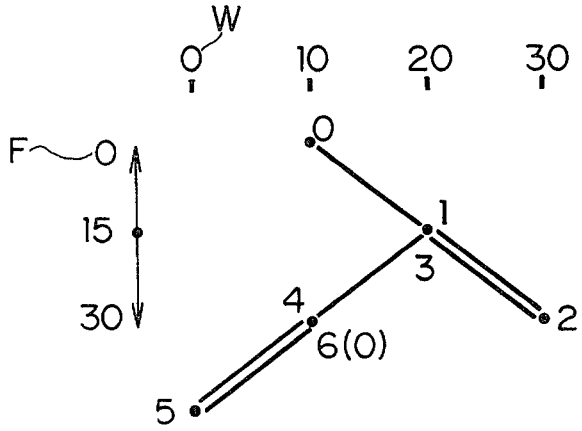
FIG. 8 shows a graph which is used to explain the operation of the invention.

As to the values of feed control data F shown in FIGS. 8 and 10, 15 is zero feed, 0 is the maximum reverse feed, and 30 is maximum feed. Now, converted feed F' produces a first stitch with maximum forward feed. Similarly, the existing data F=the next data F advances one address address of the ROM and the program returns to the RETURN point 1. This advance of the addresses advances the stitch numbers of the selected pattern N from N (No. 0) to N+5 (No. 5) in FIG. 10 with a different timing between the data W and F. When the last number N+6 is reached, the address is returned once again to the initial N to repeatedly produce the same pattern.

Figure 11:
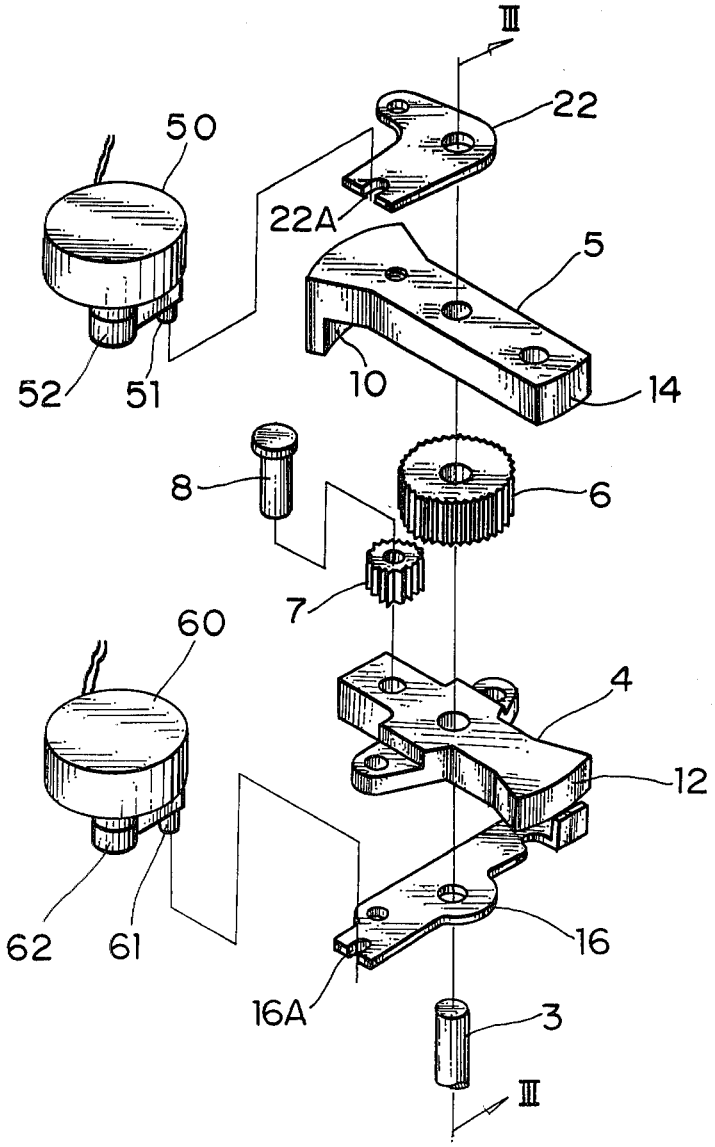
FIG. 11 is an exploded view of a modified version of the mechanism shown in FIG. 1 for use with a second embodiment of the invention.
Figure 12:
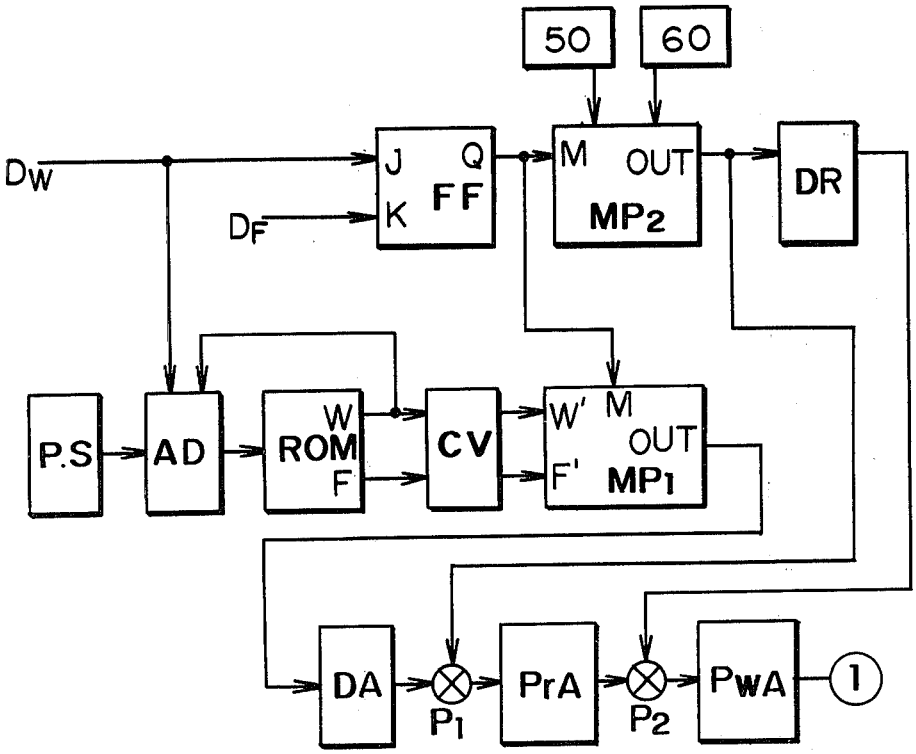
FIG. 12 is a block diagram of a second embodiment of the invention.

FIGS. 11 and 12 show another embodiment of the invention which may use the same mechanical transmission as that used in the first embodiment shown in FIGS. 1-5. The description of the second embodiment will, therefore, take place with reference to FIGS. 1-10 on the condition that reference numeral 1 denotes a servo motor. In this second embodiment, potentiometers 50, 60 are additionally employed in cooperation with needle swing control gear 5 and fabric feed control arm 4, respectively. Screening plate 22 (which is secured to the needle swing control gear 5) is formed with a groove 22A which engages with a pin 51 of potentiometer 50 for rotating potentiometer shaft 52. In the same manner, feed control link 16 (which is operated in association with fabric feed control arm 4) is formed with a groove 16A which engages with a pin 61 of the potentiometer 60 for rotating potentiometer shaft 62.

It has been explained that, as to the first embodiment of the invention, that input terminals J and K of flip-flop FF receiving needle position detecting signal Dw and feed position detecting signal $D_F$ are either both low or of logically opposite states. The same is true in FIG. 12. Therefore, if input terminal J is high, output Q becomes high and is applied to mode switching terminal M of multiplexer MP1, causing multiplexer MP1 to transmit needle swing control data W' to a digital-to-analog converter DA. On the other hand, if input terminal K of flip-flop FF is high, output Q becomes low and is applied to multiplexer MP1. Multiplexer MP1 then transmits feed control data F' to digital-to-analog converter DA. The stitch control data W', F' are converted into analog values by the digital-to-analog converter DA. The analog values are, in turn, routed to a preamplifier PrA through summer P1. The output of preamplifier PrA is applied to a power amplifier PwA through summer P2 to drive servo motor 1.

Needle control potentiometer 50 and feed control potentiometer 60 are each connected to multiplexer MP2. Multiplexer MP2 has an output terminal OUT for transmitting the position indicating signal from potentiometer 50 to the adding point P1 when needle control data W' is issued, and for transmitting the position indicating signal from potentiometer 60 to summer P1 when feed control data F' is issued. Thus, output OUT of multiplexer MP2 provides a proportional position responsive feedback control. At the same time, output OUT of multiplexer MP2 is differentiated with respect to time at a differentiating circuit DR and is taken into account at summer P2. Thus, output OUT of the multiplexer MP2 also provides a speed-responsive feedback control.

Operation of the second embodiment of the invention is as follows:

If the sewing machine is driven and needle position signal Dw becomes low, at point (a) in FIG. 7 (where the needle is not yet penetrating the fabric) servo motor 1 is set to its initial position. At point (b), pawl 34 of the needle lock control follower 33 engages the high lobe of needle lock control cam 30 and needle lock element 41 is pressed against needle swing control gear 5 to hold it and thereby fix lateral position of the needle. At point (c), feed control locking mechanism 13, which has been in its locking position, releases fabric feed control arm 4. Just before 0°, electronic memory ROM produces the initial needle control signal W for the current stitch and the feed control signal F for the next stitch at a point (not shown) which corresponds to the point at which signal Dw rises. When feed position detecting signal $D_F$ becomes high at the point (d), mode switching signal M of multiplexer MP1 causes transmission of feed control data F'. Simultaneously, multiplexer MP2 transmits the output of feed control potentiometer 60. Thus servo motor 1 is rotated by such data within a feedback loop. Gear 6 then rotates intermediate gear 7 along needle swing control gear 5 which is held fixed by needle control locking mechanism 15. Feed control locking arm 4 is, therefore, turned at an angular speed which is $\frac{1}{3}$ of that of gear 6 and is in the same direction to control movement of the feed dog through transmission link 16 and the feed regulator (not shown). Simultaneously, link 16 turns potentiometer shaft 62.

As the sewing machine is rotated further and the feed control $D_F$ becomes low at point (e), servo motor 1 finishes feeding and stops. Then, at point (f), fabric feed control arm 4 is locked by feed control locking mechanism 13, and at point (g), needle swing control gear 5 is released. When needle control signal Dw becomes high at point (h), a set of new data is read out from ROM, and mode switching signal M of multiplexer MP1 and MP2 transmits needle control data W' and the output of potentiometer 50. Thus, servo motor 1 is rotated by such data in a feedback loop. Gear 6 then rotates intermediate gear 7, and needle swing control gear 5 is rotated at an angular speed which is $\frac{1}{2}$ that of gear 6 and is in the opposite direction, to control needle swing through transmission rod 18. Simultaneously, needle swing control gear 5 rotates the potentiometer shaft 52.

I claim:

1. A system for use in a sewing machine, the system operating a needle swing mechanism and a feed dog mechanism in synchronism with rotation of a main shaft that provides mechanical motion used to reciprocate a needle, and the system accomplishing such operation using only one motor comprising:

exactly one motor;

a transmission driven by the motor and linked to the main shaft, the transmission alternately connecting and disconnecting the needle swing mechanism and the feed dog mechanism to and from the motor in accordance with position of the main shaft, the transmission operating in a manner that when a one of the feed dog mechanism and the needle swing mechanism is connected to and moved by the motor, another one of the feed dog mechanism and the needle swing mechanism is disconnected from the motor and prevented from moving; and an electronic control system in which stitch control data is stored, the electronic control system being connected to the motor and the main shaft and driving the motor by reading out the stitch control data and operating the motor in accordance therewith in synchronism with rotation of the main shaft.

2. The system defined by claim 1, wherein the stitch control data includes feed data and needle swing data, and wherein the electronic control system reads out the feed data and the needle swing data alternately, whereby the motor is alternately operated in accordance with the feed data and the needle swing data.

3. The system defined by claim 2, wherein the electronic control system includes a multiplexer, and wherein the multiplexer is linked to the motor, the multiplexer receiving the feed data and the needle control data simultaneously and transmitting only a one of them at all times, said one being alternated in accordance with rotation of the main shaft, whereby alternate operation of the motor in accordance with the feed data and the needle swing data is effectuated.

4. The system defined by claim 1, wherein stitch control data for a current stitch is subtracted from stitch control data for a next stitch within the electronic control system in order to generate differential stitch information, and wherein the system operates in a manner that the motor is operated in accordance with the differential stitch information.

5. The system defined by claim 4, wherein the electronic control system includes a computer in which stitch control data for each current stitch is subtracted from stitch control data for each next stitch, and wherein the differential stitch information is generated by the computer.

6. The system defined by claim 4, further including:

a needle potentiometer which is adjusted by needle swing and which produces a varying needle signal in response thereto; and a feed potentiometer which is adjusted by feed dog operation and which produces a varying feed dog signal in response thereto, the system operating in a manner that stitch control data for each current stitch is derived from the needle signal and the feed dog signal and subtraction is effectuated by algebraic summation within an analog motor drive stage.

7. The system defined by claim 6, wherein the potentiometers are both connected to the transmission.

8. The system defined by claim 6, wherein the electronic control system includes:

a computer generating stitch control data for each next stitch in digital form; and a digital-to-analog converter connected to the computer and converting the stitch control data for each next stitch into analog form, the digital-to-analog converter being connected to the analog motor drive stage and delivering the stitch control data for each next stitch in analog form thereto for algebraic summation therein.

9. The system defined by claim 6, wherein stitch control data for each current stitch is derived from the needle signal and the feed dog signal by differentiation taking place within a differentiator which is included in the electronic control system.

10. The system defined by claim 4, wherein:

stitch control data for each current stitch includes current feed data and current needle swing data;

stitch control data for each next stitch includes next feed data and next needle swing data;

current feed data and current needle swing data are multiplexed together in a first multiplexer;

next feed data and next needle swing data are multiplexed together in a second multiplexer; and the first and second multiplexers are synchronized together, whereby differential stitch information is generated in a sequence in which differential stitch information pertaining to needle swing alternates with differential stitch information pertaining to feed dog operation.

11. The system defined by claim 2, wherein stitch control data for a current stitch is subtracted from stitch control data for a next stitch within the electronic control system in order to generate differential stitch information, and wherein the system operates in a manner that the motor is operated in accordance with the differential stitch information.

12. The system defined by claim 11, wherein the electronic control system includes a computer in which stitch control data for each current stitch is subtracted from stitch control data for each next stitch, and wherein the differential stitch information is generated by the computer.

13. The system defined by claim 11, further including:

a needle potentiometer which is adjusted by needle swing and which produces a varying needle signal in response thereto; and a feed potentiometer which is adjusted by feed dog operation and which produces a varying feed dog signal in response thereto, the system operating in a manner that stitch control data for each current stitch is derived from the needle signal and the feed dog signal and subtraction is effectuated by algebraic summation within an analog motor drive stage.

14. The system defined by claim 13, wherein the potentiometers are both connected to the transmission.

15. The system defined by claim 13, wherein the electronic control system includes:

a computer generating stitch control data for eacn next stitch in digital form; and a digital-to-analog converter connected to the computer and converting the stitch control data for each next stitch into analog form, the digital-to-analog converter being connected to the analog motor drive stage and delivering the stitch control data for each next stitch in analog form thereto for algebraic summation therein.

16. The system defined by claim 13, wherein stitch control data for each current stitch is derived from the needle signal and the feed dog signal by differentiation taking place within a differentiator which is included in the electronic control system.

17. The system defined by claim 11, wherein:

stitch control data for each current stitch includes current feed data and current needle swing data;

stitch control data for each next stitch includes next feed data and next needle swing data;

current feed data and current needle swing data are multiplexed together in a first multiplexer;

next feed data and next needle swing data are multiplexed together in a second multiplexer; and the first and second multiplexers are synchronized together, whereby differential stitch information is generated in a sequence in which differential stitch information pertaining to needle swing alternates with differential stitch information pertaining to feed dog operation.

* * * * *